US009279253B1

(12) United States Patent
Gaydos et al.

(10) Patent No.: US 9,279,253 B1
(45) Date of Patent: Mar. 8, 2016

(54) CEILING SYSTEM

(71) Applicant: ARMSTRONG WORLD INDUSTRIES, INC., Lancaster, PA (US)

(72) Inventors: Christopher David Gaydos, Lititz, PA (US); Lori Jo L. Shearer, Millersville, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 14/542,077

(22) Filed: Nov. 14, 2014

(51) Int. Cl.

| | |
|---|---|
| ***E04B 9/34*** | (2006.01) |
| ***E04B 9/18*** | (2006.01) |
| ***E04B 9/10*** | (2006.01) |
| *E04B 9/14* | (2006.01) |
| *E04B 9/24* | (2006.01) |

(52) U.S. Cl.
CPC ... *E04B 9/34* (2013.01); *E04B 9/10* (2013.01); *E04B 9/18* (2013.01); *E04B 9/24* (2013.01); *E04B 9/248* (2013.01)

(58) Field of Classification Search
CPC ..... E04B 9/10; E04B 9/18; E04B 9/24; E04B 9/34; E04B 9/248
USPC ..... 52/506.05, 506.09
See application file for complete search history.

(56) References Cited

U.S. PATENT DOCUMENTS 1,997,580 A * 4/1935 Gibson et al. ..... 52/145
1,997,581 A * 4/1935 Heeren ..... E04B 9/26 248/228.7
3,380,206 A * 4/1968 Barnett ..... 52/145
4,089,146 A * 5/1978 Martinez ..... 52/506.08
4,463,537 A 8/1984 Rodriquez et al.
4,744,188 A * 5/1988 Ahren ..... 52/506.07
4,744,189 A 5/1988 Wilson
5,056,287 A * 10/1991 Weber ..... E04B 9/26 52/506.08
5,207,614 A * 5/1993 Passadore ..... 454/298
(Continued)

FOREIGN PATENT DOCUMENTS

DE 1132312 B * 6/1962 ..... E04B 9/18
FR 2524521 A1 * 10/1983 ..... E04B 9/003
(Continued)

OTHER PUBLICATIONS

Translation English Only Description DE1132312 translate VIA EPO; Translation Original and English Description DE1132312 translate VIA EPO.*

*Primary Examiner* — Charles A Fox
*Assistant Examiner* — Joseph J Sadlon
(74) *Attorney, Agent, or Firm* — Craig M. Sterner

(57) ABSTRACT

A ceiling system in one embodiment includes a grid support member defining a bottom surface and a ceiling panel supported by the grid support member. A first facing sheet includes a peripheral edge portion coupled to the grid support member. The first grid support member is at least partially concealed by overlapping the peripheral edge portion of the first facing sheet onto the bottom surface of the grid support member. The first facing sheet is supported from the grid support member independently of the ceiling panel. A second facing sheet has a peripheral edge portion coupled to the grid support member. The first and second facing sheets have mating edges disposed adjacent to each other which conceal a majority or substantially the entire bottom surface of the grid support member. In one embodiment, the ceiling panel has a honeycomb core.

20 Claims, 9 Drawing Sheets

(56) References Cited

U.S. PATENT DOCUMENTS

| | | | | |
|---|---|---|---|---|
| 5,414,969 | A | 5/1995 | Krejci et al. | |
| 5,845,447 | A * | 12/1998 | Bodine et al. | 52/506.09 |
| 6,125,608 | A * | 10/2000 | Charlson | 52/847 |
| 6,513,295 | B2 * | 2/2003 | Bernardino | E04B 9/001 52/407.4 |
| 7,160,600 | B2 * | 1/2007 | Shepard et al. | 428/99 |
| 7,478,506 | B2 * | 1/2009 | Wendt et al. | 52/506.07 |
| 7,716,892 | B2 * | 5/2010 | Kim | 52/506.08 |
| 7,937,903 | B2 * | 5/2011 | McGee | E04B 9/02 248/317 |
| 8,096,089 | B2 * | 1/2012 | Platt | 52/316 |
| 2006/0064939 | A1 * | 3/2006 | Kelley et al. | 52/506.07 |
| 2015/0159375 | A1 * | 6/2015 | Waters | E04B 9/0464 52/506.07 |
| 2015/0300015 | A1 * | 10/2015 | Baxter | E04B 9/067 52/506.07 |

FOREIGN PATENT DOCUMENTS

| | | | | |
|---|---|---|---|---|
| GB | 683233 | A * | 11/1952 | E04B 9/24 |
| WO | WO 2013045846 | A1 * | 4/2013 | E04B 9/20 |

* cited by examiner

CEILING SYSTEM

FIELD

The present invention relates to suspended ceiling systems with concealed support grids.

BACKGROUND

Numerous types of suspended ceiling systems and methods for mounting ceiling panels have been used. One type of system includes a suspended support grid including an array of intersecting grid support members configured to hang a plurality of individual ceiling panels therefrom. It is desirable in some cases to conceal the support grid for providing the appearance of a monolithic ceiling.

SUMMARY

A ceiling system is provided which conceals the ceiling support grid with adjoining facings or scrims between adjacent ceiling panels. The facings in certain embodiments may be coupled to and supported by the support grid independently of the ceiling panels mounted on the grid. In some embodiments, the facings may be releasably secured to the support grid and removable without damaging the facings for access to the ceiling panels and utilities above the grid.

In one embodiment, a ceiling system includes: a longitudinally extending grid support member including a longitudinal axis and a substantially horizontal bottom surface; a ceiling panel supported by the grid support member; a first facing sheet having a peripheral edge portion; and a coupling mechanism that couples the peripheral edge portion of the first facing sheet to the bottom surface of the grid support member, the grid support member supporting the first facing sheet; wherein the bottom surface of the first grid support member is at least partially concealed by the peripheral edge portion of the first facing sheet.

In another embodiment, a ceiling system includes: a first longitudinally-extending grid support member and a second longitudinally-extending grid support member spaced apart from the first grid support member, each of the first and second grid support members defining a longitudinal axis and a substantially horizontal bottom surface; a ceiling panel extending between the first and second grid support members, the ceiling panel supported by the first and second grid support members; a first facing sheet spanning between the first and second grid support members, the first facing sheet coupled to and supported from the bottom surfaces of the first and second grid support members at peripheral edge portions of the first facing sheet; and a second facing sheet spanning between the first grid support member and a third grid support member spaced apart from the first grid support member, the second facing sheet coupled to and supported from the bottom surface of the first grid support member at a peripheral edge portion of the second facing sheet; the first and second facing sheets having respective adjacent edges positioned proximate to each other below the bottom surface of the first grid support member; wherein the bottom surface of the first grid support member is concealed by the peripheral edge portions of the first and second facing sheets.

A method for concealing a grid support member of a ceiling system is provided. The method includes the steps of: providing a first longitudinally-extending grid support member and a second longitudinally-extending grid support member spaced apart from the first grid support member, each of the first and second grid support members including a substantially horizontal flange defining an upward facing top surface and a downward facing bottom surface; positioning a first ceiling panel on the top surfaces of the first and second grid support members, the first ceiling panel spanning between the first and second grid support members; and attaching a first facing sheet to the bottom surfaces of the first and second grid support members, the first facing sheet spanning between and supported by the first and second grid support members; wherein the first facing sheet at least partially conceals the bottom surfaces of the first and second grid support members.

The method may further include: attaching a peripheral edge portion of a second facing sheet to the bottom surface of the first grid support member; and positioning a linear peripheral edge of the second facing sheet adjacent and proximate to the linear edge of the first facing sheet to form a substantially uniform narrow seam, wherein the first and second facing sheets conceal a majority of the bottom surface of the first grid support member.

In one embodiment, a facing sheet for concealing a grid support of a ceiling system includes: a substantially flat body having a rectilinear shape and four corners; a pair of first and second spacers; the first spacer attached to the facing sheet at a first corner on a first peripheral side of the facing sheet; the second spacer attached to the facing sheet at a second corner on the first peripheral side of the facing sheet; and a resiliently deformable tensioning rod having a first end coupled to the first spacer and a second end coupled to the second spacer, the tensioning rod being at least partially deflected to force the first and second corners apart and draw the facing sheet taut between the first and second corners.

BRIEF DESCRIPTION OF THE DRAWINGS

The features of the exemplary embodiments of the present invention will be described with reference to the following drawings, where like elements are labeled similarly, and in which.

Figure 1:
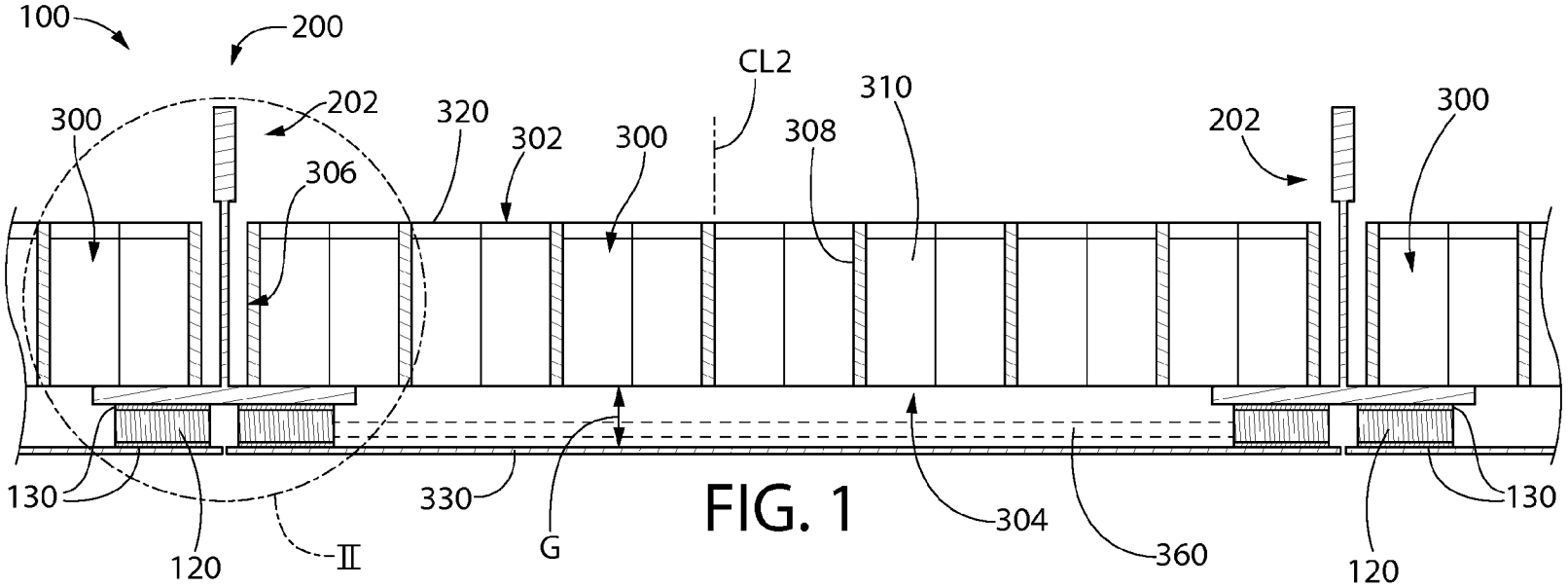
FIG. 1 is a side elevation cross-sectional view of a ceiling system comprising grid support members and ceiling panels.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
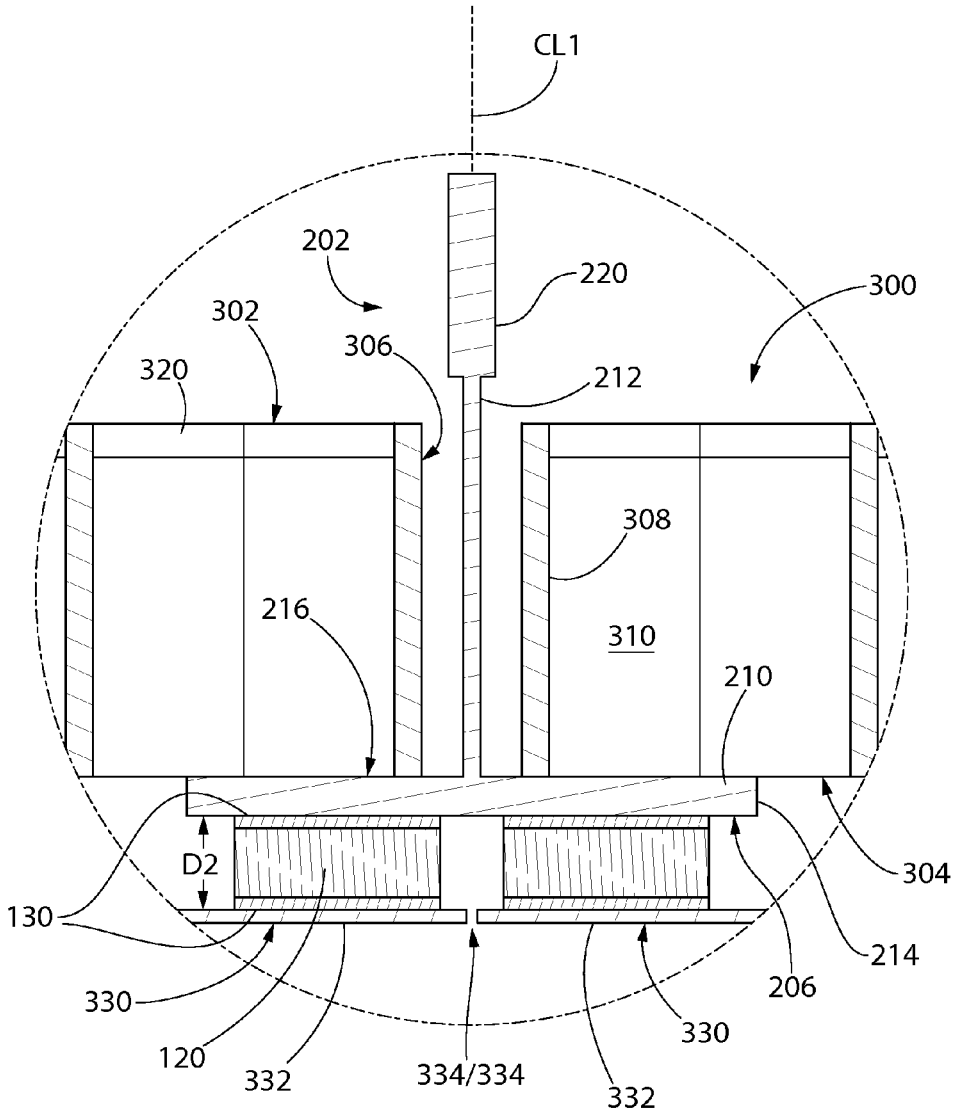
FIG. 2 is an enlarged view from FIG. 1.

FIGS. 1 and 2 depict an exemplary embodiment of a ceiling system 100 according to the present disclosure. The ceiling system 100 generally includes an overhead support grid 200 including a plurality of overhead longitudinal grid support members 202, ceiling panels 300 supported by the grid support members, and bottom facing sheets 330. The bottom facing sheets 330 are separate components and may be supported from the grid support member independently of the ceiling panels 300.

Figure 4:
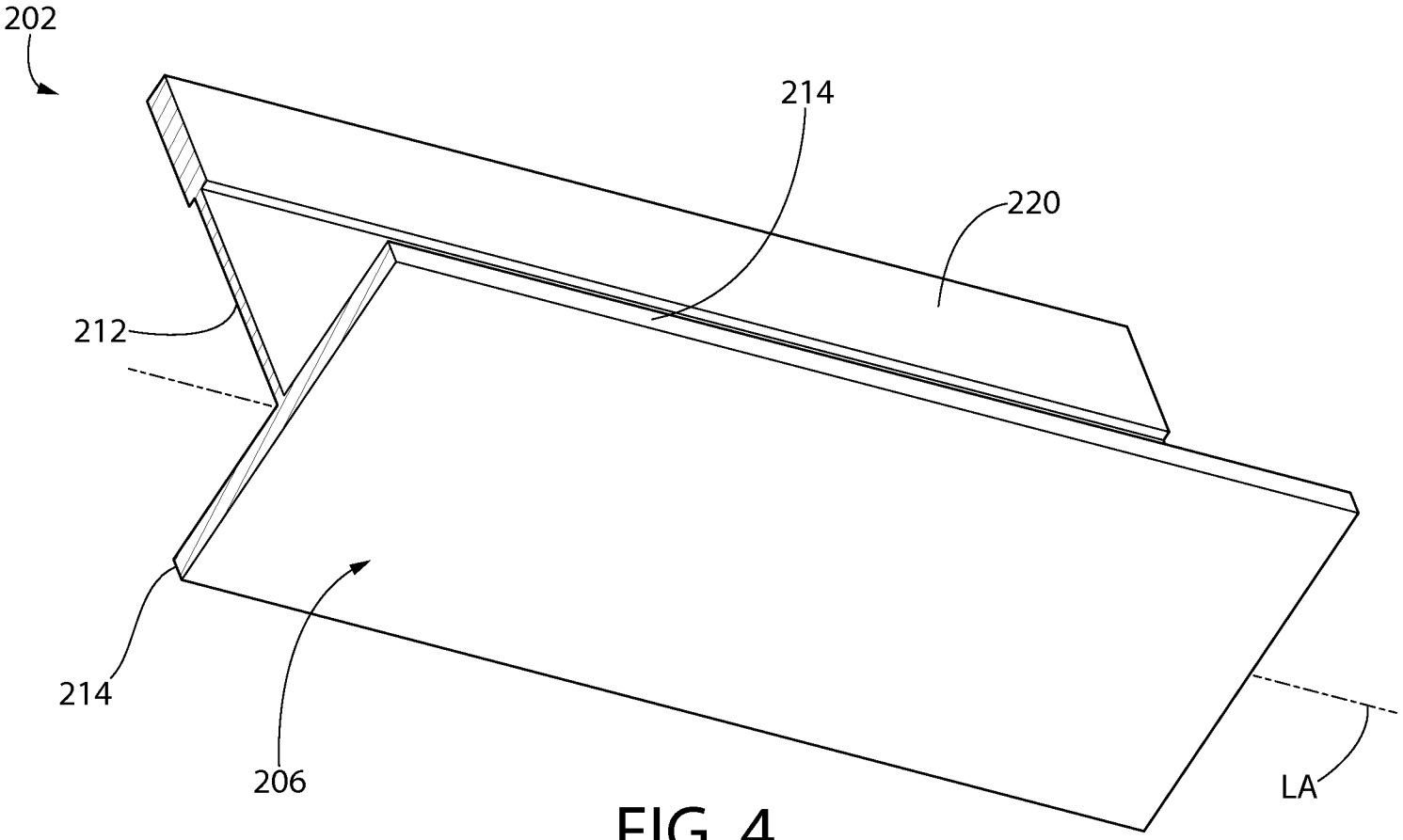
FIG. 4 is a cross-sectional bottom perspective view of the grid support member.

Referring to FIGS. 1, 2, and 4, the grid support members 202 are mountable in a suspended manner from an overhead building support structure. Grid support members 202 are elongated in shape having a length greater than their width (e.g. at least twice), and in various embodiments lengths substantially greater than their widths (e.g. 3 times or more). The grid support members 202 may form "runners" or "rails" and are laterally spaced apart and oriented parallel to each other as shown in FIG. 1 to position a ceiling panel 300 therebetween. In some embodiments, the longitudinal grid support members 202 may be maintained in a substantially parallel spaced apart relationship to each other by lateral grid support members (not shown) attached between adjacent (but spaced apart) grid support members 202 at appropriate intervals using any suitable permanent or detachable manner of coupling.

In one embodiment, grid support members 202 may be horizontally oriented when installed. It will be appreciated, however, that other suitable mounted orientations of grid support members 202 such as angled or sloped (i.e. between 0 and 90 degrees to horizontal) may be used. Accordingly, although support members 202 may be described in one exemplary orientation herein as horizontal, the invention is not limited to this orientation alone and other orientations may be used.

With continuing reference to FIGS. 1, 2, and 4, grid support members 202 may be T-shaped (e.g. T-rails) in transverse cross section. The grid support members have an inverted T-shaped configuration when in an installed position suspended from an overhead building ceiling support structure. The grid support members 202 may be suspended from the building ceiling support structure via an appropriate hanger mechanism, such as for example without limitation fasteners, hangers, wires, cables, rods, struts, etc.

Grid support members 202 may each include a longitudinally-extending horizontal bottom flange 210, an enlarged top stiffening channel 220, and a vertical web 212 extending upwards from the flange to the stiffening channel. In some embodiments, the top stiffening channel 220 may be omitted. The grid support members 202 each define a respective longitudinal axis LA and axial directions. Bottom flange 210 has opposing portions which extend laterally outwards from web 212 and terminate in opposed longitudinally extending edges 214. Web 212 may be centered between the edges 214 and vertically aligned with the centerline CL1 of the grid support member in one non-limiting embodiment. In other embodiments, the web 212 may be laterally offset from centerline CL1. Bottom flange 210 further defines a bottom surface 206 facing downwards away from the flange and towards a room or space below the support grid 200. Bottom surface 206 defines a horizontal ceiling reference plane for the overhead support grid 200. Flange 210 further defines a top surface 216 for positioning and supporting the ceiling panel 300 thereon.

Grid support members 202 may be made of any suitable metallic or non-metallic materials structured to support the dead weight or load of ceiling panels 300 without undue deflection. In some non-limiting embodiments, the grid support members may be made of metal including aluminum, titanium, steel, or other. In one embodiment, the grid support members 202 may be a standard heavy duty 15/16 inch aluminum T-rail.

Figure 3:
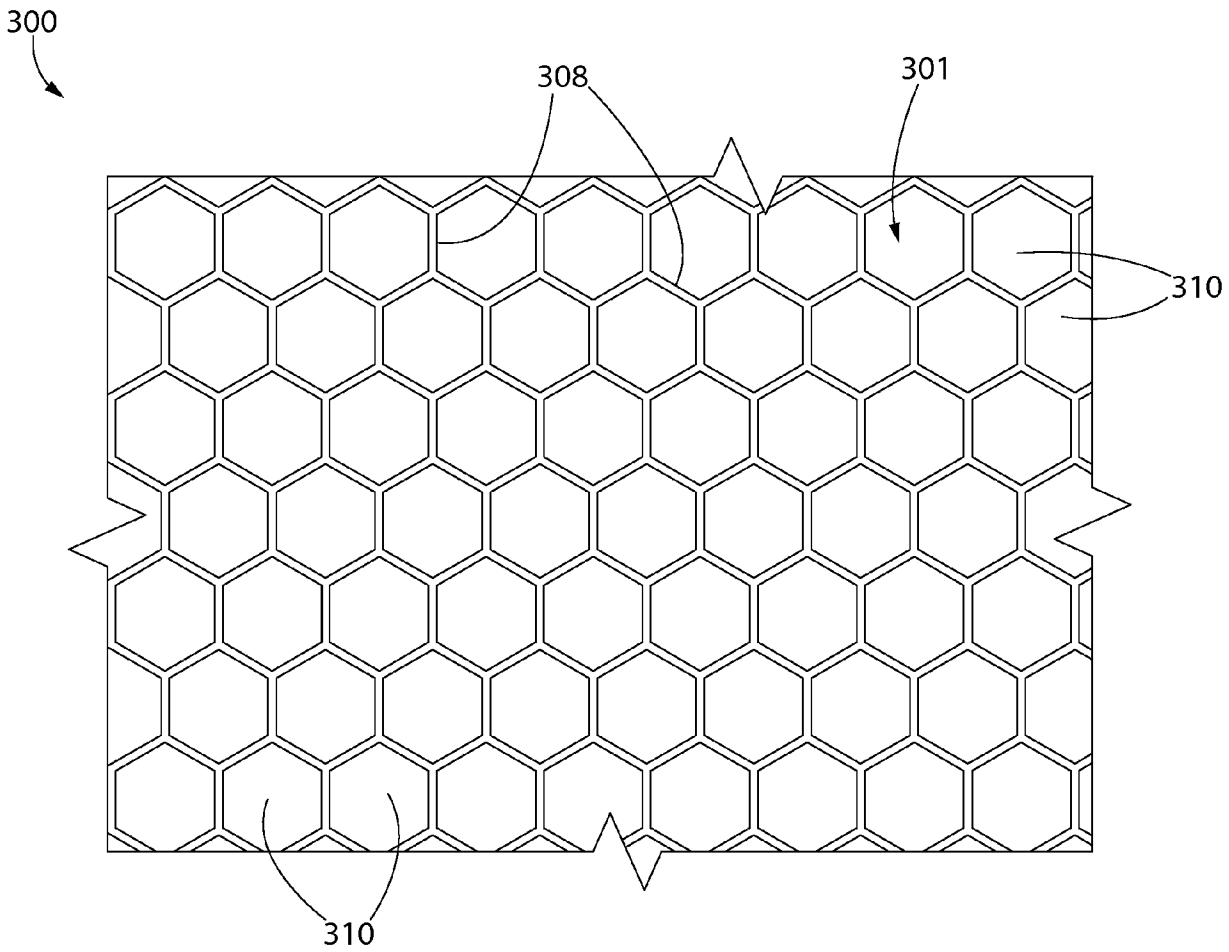
FIG. 3 is a transverse cross-section of the ceiling panel showing one embodiment of a core structure of the ceiling panel.

Referring now FIGS. 1-3, ceiling panel 300 may have a generally flattened body with a substantially greater horizontal width and length than vertical thickness as shown. Ceiling panel 300 includes a top surface 302, bottom surface 304, and lateral sides 306 extending therebetween along four sides of the panel. Sides 306 define outward facing peripheral surfaces which may be oriented substantially parallel to the vertical centerline CL2 of the ceiling panel 300. In some embodiments, the peripheral surfaces may be angled or sloped, or have a stepped (tegular) edge profile or configuration. Top and bottom surfaces 302, 304 may be generally planar and arranged substantially parallel to each other in one non-limiting embodiment.

Ceiling panels 300 may be constructed of any suitable material including without limitation mineral fiber board, fiberglass, jute fiber, metals, polymers, wood, composites, resin impregnated kraft paper, or other. In addition, the ceiling panels 300 may have any suitable dimensions and shapes (in top plan view) including without limitation square or rectangular.

In one embodiment, ceiling panels 300 may have an inner core 301 comprising a honeycomb structure formed from a plurality of interconnected cell walls 308 that define a plurality of open cells 310 (best shown in FIG. 3). The cell walls 308 are oriented perpendicular to the top and bottom surfaces 302, 304 of the ceiling panels 300 and extend vertically between the top and bottom surfaces. Any suitable shape of cells 310 (in top plan view) may be used, including hexagon, triangular, square, circular, etc. as some non-limiting examples.

In one embodiment, the core 301 may be formed by paper cell walls 308. Paper used to construct cell walls 308 may be at least 20 pound kraft paper, and in some embodiments 20 to 80 pound kraft paper (thicknesses of about 0.004 to 0.015 inches) which generally provides the requisite stiffness to the core to resist sagging of the ceiling panel without unduly adding weight to the ceiling panel structure. As opposed to other materials, paper is generally more economical and cost-effective as a core wall material. The paper may be resin-impregnated in some embodiments. In other possible embodiments, lightweight non-paper material such as fiberglass and thin aluminum metal sheet also may perform satisfactorily for cell walls and be used.

With continuing reference to FIGS. 1-3, ceiling panel 300 may further include a top facing sheet 320. The facing sheet 320 may be directly or indirectly coupled to the core 310 thereby forming part of the ceiling panel structure. The facing sheet 320 may be permanently bonded to core 301 using a suitable industrial adhesive 35 which is applied to the exposed upper edges of the core cell walls 308, thereby closing the upper ends of the cells 310. Industrial adhesives which may be used include Swift® tak from H.B. Fuller Company and others. The combination of core 301 and the top facing sheet 320 collectively form a relatively rigid composite structure which resists sagging when installed in the support grid 200.

Figure 9:
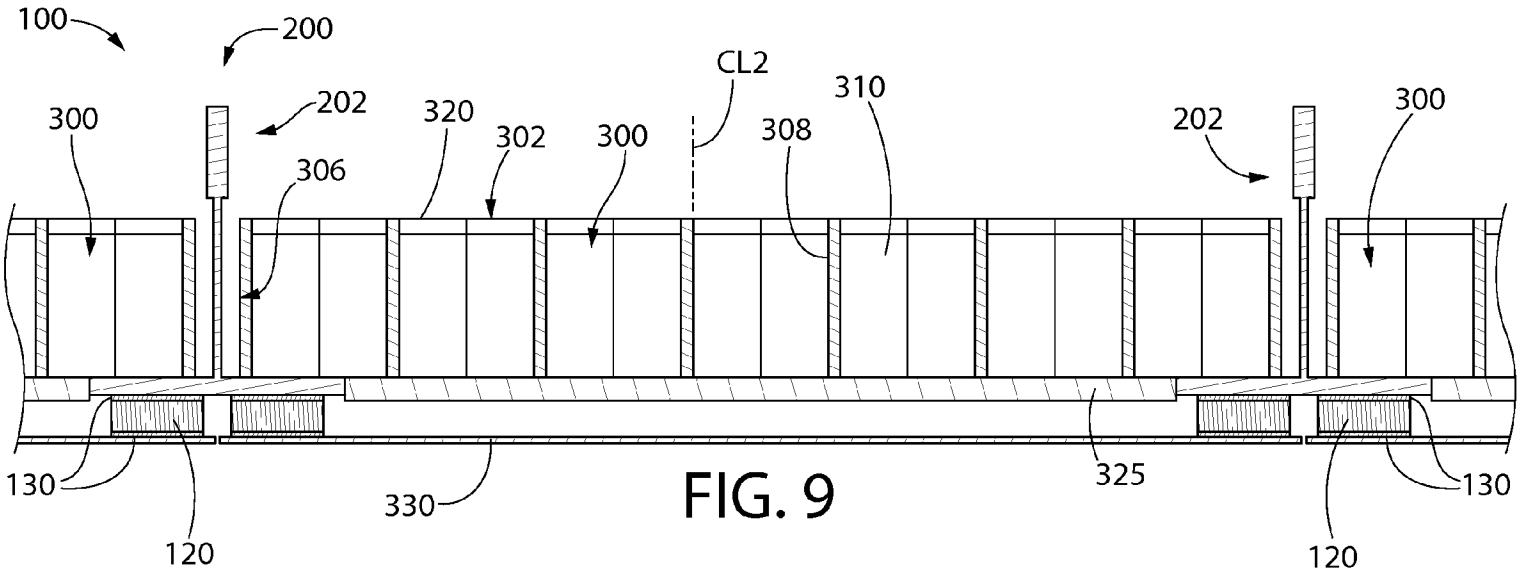
FIG. 9 is a side elevation cross-sectional view of a fourth embodiment of a ceiling system showing an alternative construction of the ceiling panel including a spacer panel.

Ceiling panel 300 may further include a spacer panel 325 in some embodiments as shown in FIG. 9. Spacer panel 325 may be permanently attached to the bottom of ceiling panel 300. In some embodiments, the attachment may be made via a suitable industrial adhesive (e.g. Swift® tak adhesive from H.B. Fuller Company and others). Spacer panel 325 may be in the form of a substantially flat sheet of material having a thickness (measured vertically) sufficient to make up and fill the vertical gap between the bottom of ceiling panel core 301 and bottom surface 206 of grid support member 202 (which substantially equates to the thickness of the flange 210). This locates the bottom facing sheet 330 in a vertical position that is substantially flush with the bottom surface 206 on the grid support member bottom flange 210. Spacer panel 325 has a horizontal width dimensioned to fit and extend between opposed edges 214 of a pair of grid support members 300. When a ceiling panel 300 having a honeycomb core 301 is used, the spacer panel 325 may provide a convenient and cost-effective means to fill the gap between the grid support member flanges 210 rather than cutting of the open-celled honeycomb core to form a stepped side edge profile at the sides of the ceiling panel. In addition, the spacer panel 325 structurally reinforces the ceiling panel 300 providing additional rigidity to the composite construction.

Figure 8:
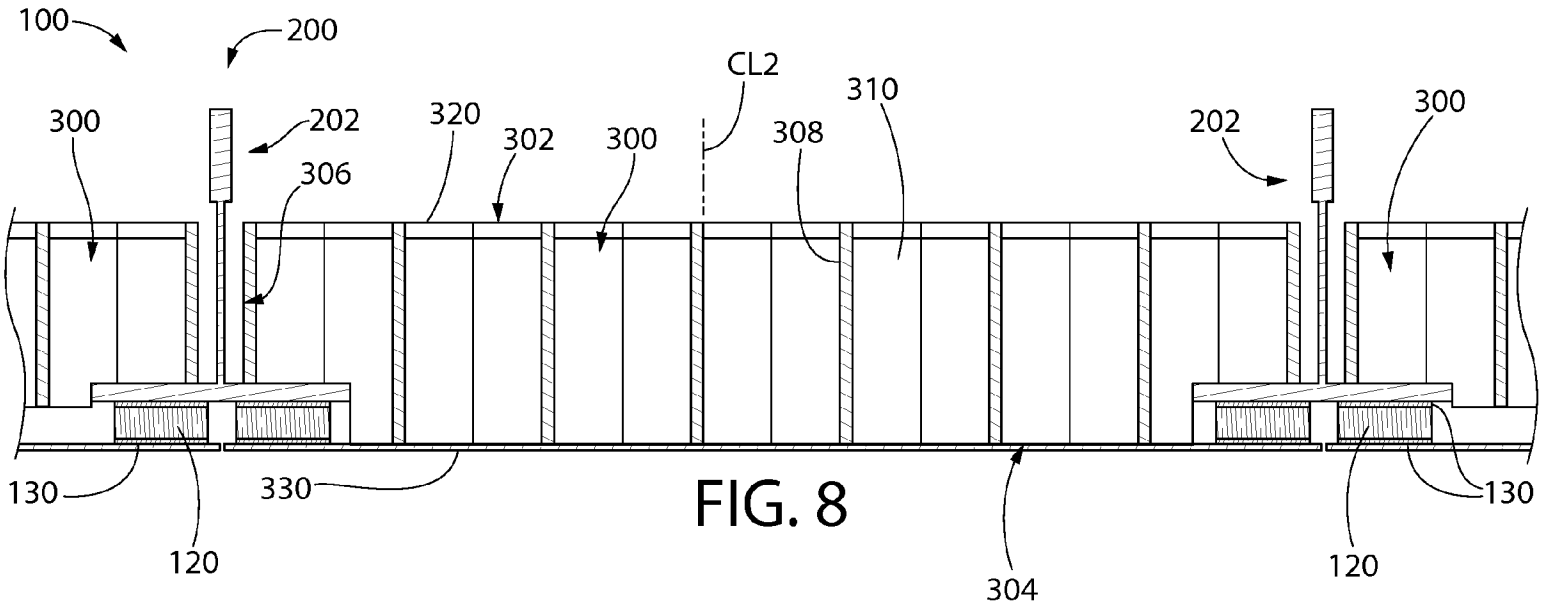
FIG. 8 is a side elevation cross-sectional view of a third embodiment of a ceiling system showing an alternative construction of the ceiling panel.

In alternative embodiments as shown in FIG. 8, the ceiling panel 300 may have a sufficient vertical thickness between the sides 306 and an integral stepped or tegular side edge profile or configuration (in transverse cross section) so that the bottom facing sheet 330 contacts, but is not necessarily attached to the ceiling panel. In some embodiments, the bottom facing sheet 330 may be attached to the bottom 304 of the ceiling panel.

Either construction of FIG. 1 or 10 essentially forms a tegular ceiling panel 300 having a stepped side edge profile (see also FIG. 2) so that the ceiling panel may be seated on and supported by the top surface 216 of the grid support member's bottom flange 210. This stepped edge profile also helps to properly horizontally position and secure the ceiling panels 300 between the grid support members 202.

Figure 5:
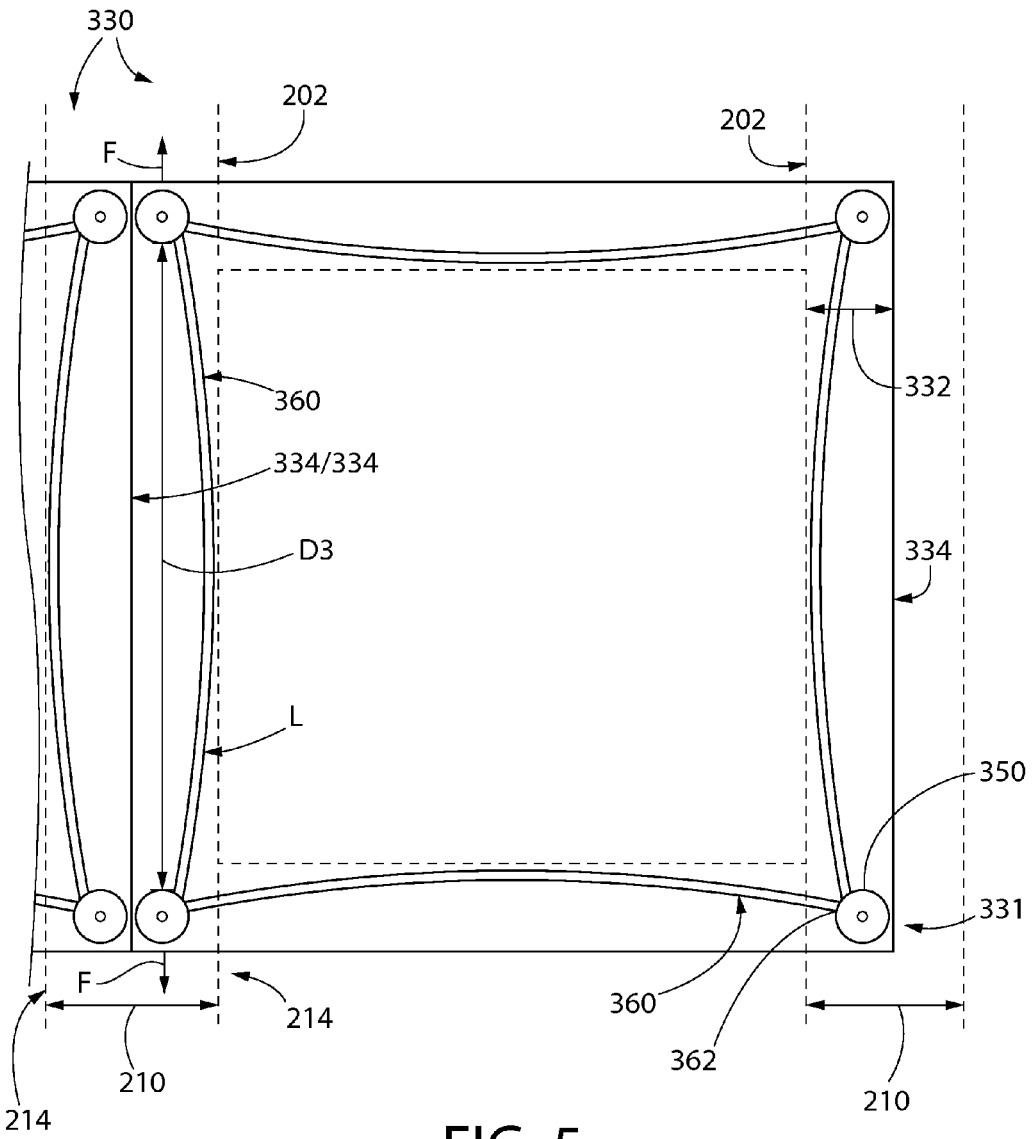
FIG. 5 is a top plan view of a bottom facing sheet with tensioning rod system.

FIG. 5 is a top plan view of a bottom facing sheet 330, which is not part of the ceiling panel 300, but rather is a separate discrete component not attached directly thereto in one embodiment. When supported solely from the grid support member 202 as further described herein therefore, a vertical gap G may be formed between the bottom surface 304 of the ceiling panel 300 and the bottom facing sheet 330 as shown in FIGS. 1 and 2.

Bottom facing sheets 330 are formed of a thin, substantially flat material with a transverse thickness substantially less than the width or length of the sheet. In some representative non-limiting embodiments, bottom facing sheets 330 may have a thickness ranging from 0.05 mm to 25 mm or more such as with polymeric non-woven materials.

Bottom facing sheets 330 may be made of any suitable material of rigid or semi-rigid construction sufficient to remain relatively flat without undue deflection when mounted between a pair of spaced apart grid support members 202 (see, e.g. FIG. 1). In some embodiments, facing sheets 330 may be made of a non-woven material which optionally may be treated such as with a porous coating to reduce reverberated sound. Non-wovens including open cell foams may include small cavities to attenuate sound. Bottom facing sheet 330 may be site painted in the field or pre-painted in various embodiments.

Representative but non-limiting examples of facing materials that may be used include non-woven veils or scrim (e.g. fiberglass or polymeric), perforated films or sheets, open cell foamed panels, woven fabrics, and wet or dry laid built up fibrous panels. These materials can offer sufficient opaqueness and flatness for a uniform and acceptable appearance.

In some embodiment, bottom facing sheet 330 may have a rectilinear shape as shown in FIG. 5, such as without limitation square or rectangular. In those examples, each bottom facing sheet 330 includes four corners 331 and linear peripheral edge portions 332 extending around the perimeter of the sheet that defines corresponding peripheral edges 334. Other suitable shapes of bottom facing sheets 330 may be provided depending on the pattern or layout of the grid support members 202 from which the sheets 330 are mounted and supported.

Although FIG. 5 shows bottom facing sheet 330 in a discrete panel or tile-like form with predetermined fixed width and length, it will be appreciated that in other embodiments a roll of material may instead be used having a fixed width but variable longitudinal length which can be cut in the field to suit the specific installation requirements.

Depending on the material selected for bottom facing sheet 330, the sheet may have tendency to unduly sag or deflect in the unsupported span between the grid supports members 202 (see, e.g. FIG. 1) because the sheet is supported at only the peripheral edge portions 332. To help maintain and enhance the flatness of the bottom facing sheet 300 in some embodiments where the material used may have some degree of flexibility and tendency to sag, tensioning rods 360 may optionally be provided as shown in FIG. 5.

Referring to FIG. 5, the opposite ends 362 of each tensioning rods 360 may be attached between adjacent (i.e. non-diagonal) corners 331 of the bottom facing sheet 330. The tensioning rods 360 may be formed of a suitable resiliently deformable metal having material properties which create an elastic memory. In one exemplary embodiment, the tensioning rods 360 may be made of spring steel. The rods 360 may have wire-like structure in one embodiment with a modicum of stiffness, but sufficient flexibility to allow the rods to be elastically deformed. This allows the rods 360 to act as spring members creating opposing forces F that bias adjacent corners 331 of the bottom facing sheet 330 apart in opposite directions (see force arrows in FIG. 5 corresponding to said directions). Tensioning rods 360 are shown in an elastically deformed and deflected condition in which the rods may assume an arcuately curved shape in top plan view.

The tensioning rods 360 may be attached to the corners 331 of bottom facing sheet 330 via any suitable mounting element 350 configured to capture the ends 362 of the rods. In one non-limiting embodiment, the mounting element 350 may be spacer 120 which also functions to space the bottom facing sheet 330 vertically apart from the bottom surface 206 of grid support member 202 by a distance D2 (see also FIGS. 1 and 2). In one embodiment, the spacers 120 may have laterally facing sockets which are configured and arranged to receive the ends 362 of the tensioning rods 360 as shown in FIG. 5.

In the undeformed condition, the tension rods 360 may have a generally straight shape in the unassembled deactivated condition. To assemble the rods 360 to the spacers 120, one end of the rod may first be engaged with a first spacer on one corner 331 of bottom facing sheet 330. The tension rod 360 may then be slightly bent/deflected to allow the second end of the rod to be engaged with a second spacer 120 in an adjacent corner 331 (see FIG. 5). This deformation activates the elastic spring properties of the tensioning rod 360 which now assumes the arcuately curved shape shown. Preferably, the length L of the tensioning rods 360 is larger than the distance D3 between the adjacent spacers 120 in order activate the biasing force of the rods.

It will be appreciated that other suitable cross-sectional shapes of tensioning rods 360 other than circular may be used, including without limitation square or rectangular strap-like shapes. In addition, other arrangements and attachment of the tensioning rods 360 to the corners of the bottom facing sheet 330 are possible.

Coupling of bottom facing sheets 330 to adjacent spaced apart grid support members 202 will now be further described. Referring initially to FIGS. 1 and 2, the bottom facing sheets 330 in one embodiment each span between the grid bottom facing sheet 330 and may be coupled only to the grid support members for support. Accordingly, the bottom facing sheets 330 are structurally discrete elements supported by the grid independently of the ceiling panels also mounted thereon.

Each bottom facing sheet 330 may be directly or indirectly coupled to the grid support members 202 via an intermediate structure. An indirect coupling arrangement will first be described with continuing reference to FIGS. 1 and 2. For securing the bottom facing sheet 330 to the grid support member 202, a coupling mechanism is provided which is disposed between the bottom surface 206 of the grid support member and peripheral edge portion 332 of the facing sheet. The coupling mechanism may include a spacer 120 and fastening elements 120 which attach the spacer in turn to both the bottom facing sheet 330 and bottom surface 206 of the grid support member 202 via fastening elements 130. Any suitable fastening element 130 may be used. In one embodiment, the fastening elements 130 may be adhesives such as spray or liquid adhesives (such as those described herein or other), or double-sided adhesive tape of suitable shape and dimensions. In other embodiments, the fastening elements(s) 130 may be hook and loop closures such as Velcro®. In yet other possible embodiments, the fastening elements 130 may be magnetic such as without limitation magnetic strips. In the latter embodiment, the spacer 120 may itself be a magnet which is attached to the top surface of the bottom facing sheet 330 via a fastening element 130 at the bottom end and coupled directly to a ferritic grid support member 202 at the top end via magnetic force without a separate fastening element. It will be appreciated that various combinations of the foregoing adhesive, magnetic, or hook and loop fastening elements 130 may be used together in some embodiments where top and bottom fastening elements are required for mounting the spacer 120 and bottom facing sheet 330. Various types of fastening elements 130 other than the foregoing non-limiting examples may alternatively be used.

As noted above and shown in FIGS. 1 and 2, the spacers 120 of the coupling mechanism function to space the bottom facing sheet 330 vertically apart from the bottom surface 206 of grid support member 202 by a distance D2. In some embodiment, the spacers 120 may have a height making D2 greater than the thicknesses of the bottom facing sheet 330 and/or bottom flange 210 of the grid support members 202, alternatively greater than twice or three times the thicknesses of the facing sheet and/or bottom flange. The spacers 120 also distance the bottom facing sheet 330 from the bottom surface of the ceiling panel 300 as shown.

The spacers 120 may have any suitable configuration. In some embodiments, the spacers 120 may be round in top plan view as depicted for example in FIG. 5 showing dual purpose mounting elements 350 which may also be spacers 120. In other configurations, the spacers 120 may have polygonal or rectilinear shapes of any suitable size and length.

Any suitable number of spacers 120 may be provided to support the bottom facing sheets 330 by the peripheral edge portions 332 without undue sagging or deflection therebetween to maintain tautness and relative flatness of the sheets. In the embodiment shown in FIG. 5 for example, four spacers 120 disposed at the corners of a sheet or tile-like bottom facing sheet 330 may be provided. In embodiments where the bottom facing sheet 330 may be provided in a roll of material for field cutting, more than four spacers 120 may be provided as needed to maintain tautness of the facing sheet along the length of the grid support members 202.

Spacers 120 may be formed of any suitable material, including for example without limitation metallic, polymeric, magnetic, foamed, and single or multiple layers of non-woven materials. In some embodiments, the spacers 120 may be a mechanical clip or part of the fastener.

FIGS. 1 and 2 depict a first embodiment of a ceiling system 100 formed using spacers 120. In this arrangement, the mating peripheral edges 334 of the two adjacent bottom facing sheets 330 lie approximately in the same horizontal plane (accounting for installation variances/tolerances). The two adjacent edges 334 are substantially flush in a horizontal plane and distanced substantially uniformly by distance D2 with respect to the horizontal bottom surface 206 of the grid support member 202. A relatively tight (close) seam or joint may be formed between the mating peripheral edges 334 with any visible gap being left as is, filled with caulking and/or painted over as desired. In other possible embodiment, a wider gap may intentionally be formed at the joint between the peripheral edges if desired for specific visual effects.

Figure 6:
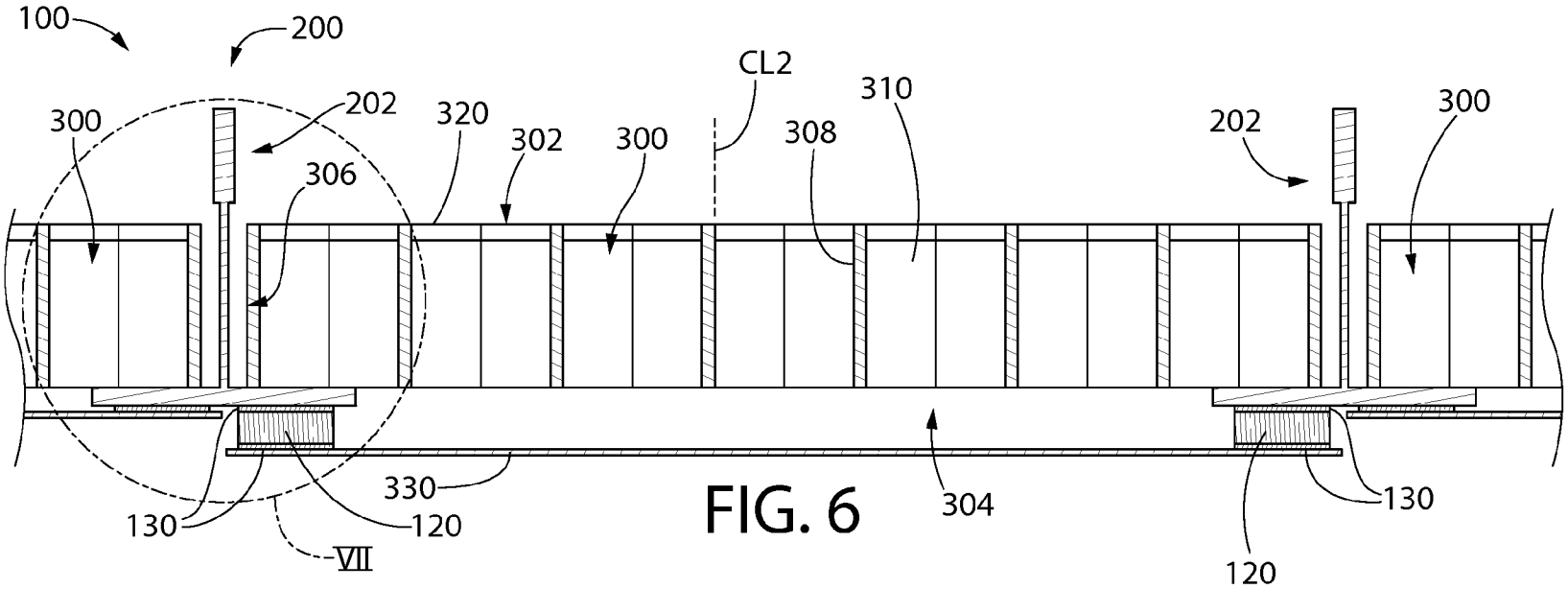
FIG. 6 is a side elevation cross-sectional view of a second embodiment of a ceiling system having alternating height facings.
Figure 7:
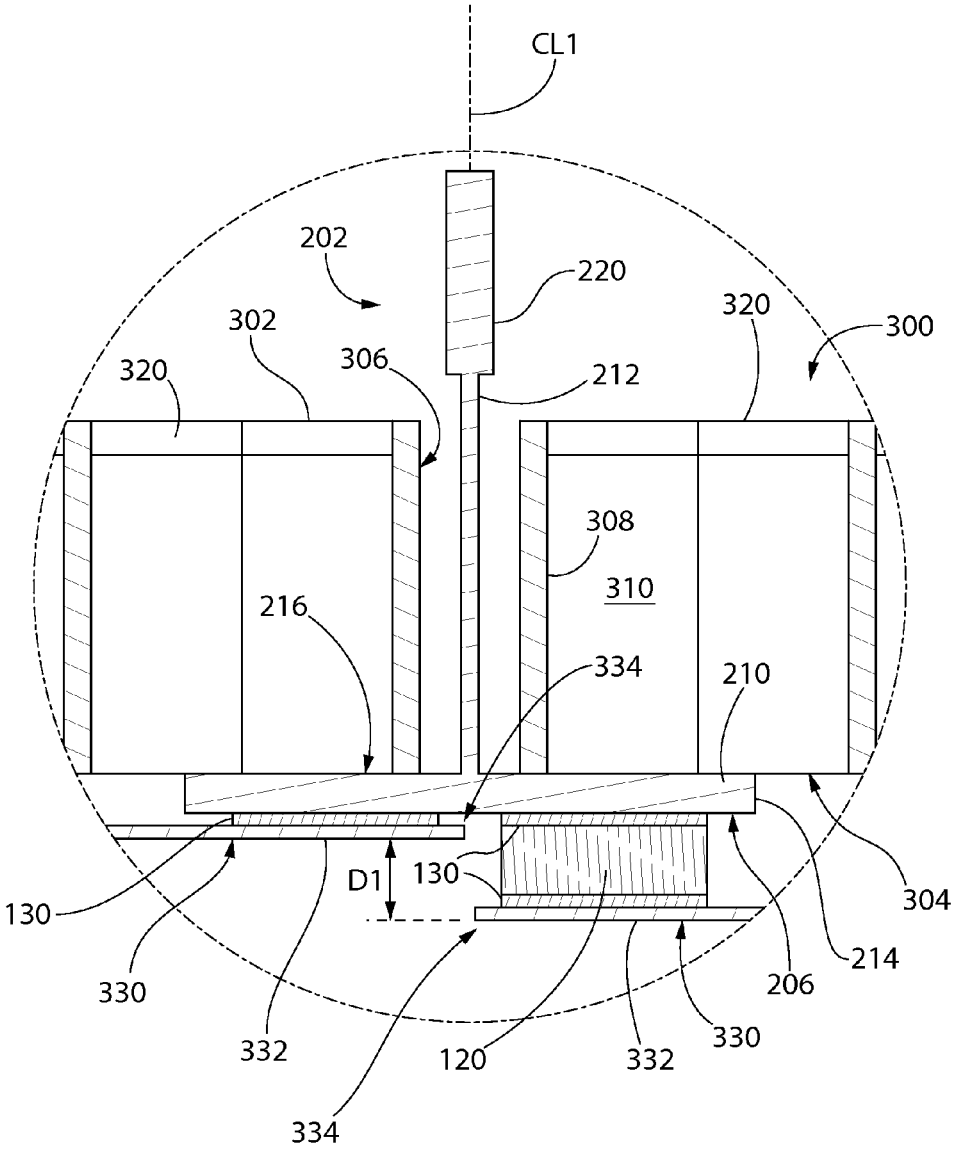
FIG. 7 is an enlarged view from FIG. 6.

FIGS. 6 and 7 depict a second embodiment of a ceiling system 100. In this embodiment, one bottom facing sheet 330 is indirectly coupled to a grid support member 202 using spacers 120 while the adjacent second bottom facing sheet 330 is directly coupled attached to the same grid support member using a single fastening element 130. This vertically offsets the two adjacent peripheral edges 334 of the bottom facing sheets 330 beneath the flange bottom surface 206 of the grid support member 202 by a distance D1. This creates a different stepped visual appearance of the joint or seam formed between the two adjacent bottom facing sheets 330 than the substantially flush bottom facing sheets shown in FIGS. 1 and 2. The discontinuous or different heights of the bottom facing sheets 330 may aid in concealing alignment, installation, or other squareness or lapping issues. Any of the foregoing types of fastening elements 130 described above or others may be used to directly couple the bottom facing sheet 330 lying substantially flush with the bottom surface 206 of the grid support member 202 (left side) to the grid support member.

A method for concealing a grid support member 202 of a ceiling system 100 will now be described with initial reference to FIGS. 1 and 2.

A first and second grid support member 202 are provided and hung from an overhead ceiling support structure in the arrangement shown in FIG. 1. The grid support members 202 are horizontally spaced apart. The bottom flanges 210 substantially lie in a common horizontal plane.

A first ceiling panel 300 is positioned on the top surfaces 216 of bottom flanges 210 of the first and second grid support members 202, as further shown in FIG. 2 in greater detail. The peripheral edge portions of the ceiling panel adjacent the lateral sides 306 are seated atop the flanges 210. The ceiling panel 300 spans between the first and second grid support members 202 and is unsupported between the peripheral edge portions. The ceiling panel 300 may have any of the configurations, construction, and edge details disclosed herein or others.

A first bottom facing sheet 330 is provided ("first facing sheet" hereafter for brevity). In the present embodiment being described, the first facing sheet 330 is configured as shown in FIG. 5 and includes spacers 120 conveniently pre-mounted thereon in the peripheral edge portions 332 at the four corners via a fastening element 130. In other possible embodiments, the spacers may instead be mounted separately on the flanges 210 of the grid support members 202 if the precise horizontal spacing between all the grid support members 202 is not known or may vary (e.g. retrofit installations). Either arrangement is acceptable.

Next, the first facing sheet 330 is attached to the grid support member 202. Assuming the spacers 120 are pre-mounted on the facing sheet (FIG. 5), the first facing sheet 330 is mounted on the bottom surface 206 of the first grid support member 202 using a fastening element 130. This mounts the peripheral edge portion 332 on a first lateral side of the first facing sheet 330 to the first grid support member 202. The peripheral edge portion 332 on the opposite lateral side of the first facing sheet 330 is also mounted on the second grid support member 202 in a similar manner. The first spacing sheet 330 thus spans between the first and second grid support members 202 and is supported from the bottom surface 206 of the grid support member flange 210, independently of the first ceiling panel 300.

The linear peripheral edge 334 of first facing sheet 330 is positioned between the longitudinal edges 214 of the grid support member 202, thereby extending at least partially across and partially concealing the bottom surface 206 of the first grid support member (see FIG. 2). In one embodiment, the peripheral edge 334 is positioned approximately at the midpoint between the opposing longitudinal edges 214 of the first grid support member 202 and vertically aligned approximately with the vertical web 212 of the support. In one embodiment, approximately ½ of the grid support member bottom surface 206 is concealed by the first facing sheet 330. The peripheral edge 334 and peripheral edge portion 332 of the first facing sheet 330 is spaced vertically from the bottom surface 206 of the first grid support member 202 by vertical distance D2 by the spacer 120 disposed therebetween.

To fully conceal the first grid support member 202, a peripheral edge portion 332 of a second facing sheet 330 is attached to the bottom surface 206 of the first grid support member in a similar manner to the first facing sheet 330 as described above. The linear peripheral edge 334 of the second facing sheet 330 is positioned adjacent and proximate to the linear edge 334 of the first facing sheet 330 to form a substantially uniform narrow seam. The peripheral edge portion332 of second facing sheet 330 extends across the bottom surface 206 of the first grid support member 202 with its peripheral edge 334 terminating at the mating peripheral edge 334 of the first facing sheet 330. The entire bottom surface 206 of the first grid support member 202 is now completely concealed by the peripheral edge portions 332 of the first and second facing sheets 330, except for the narrow seam or joint formed therebetween which preferably is narrow enough to not be visible or can be caulked or painted over to complete the concealment as needed. A monolithic ceiling appearance is created.

It will be appreciated that the same forgoing installation method may be used for facing sheet arrangements/layouts with a stepped appearance as shown in FIGS. 6 and 7. In that embodiment, the only variation is that the second facing sheet 330 (left one) does not include a spacer 120 so that the facing sheet is directly attached to the bottom surface 206 of the first grid support member 202 using a fastening element 130 as shown. The first facing sheet 330 (right) lies in a horizontal plane different and lower than the second facing sheet (left) 330 being offset by vertical distance D1. It should be noted that the ceiling system 100 may use any combination of the foregoing mounting methods using spacers or no spacers to raise or lower various sections of the installed ceiling to create different visual effects.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling system comprising:

a longitudinally extending grid support member including a longitudinal axis and a substantially horizontal bottom surface;

a ceiling panel supported by the grid support member;

a first facing sheet having a flat body defined by a top planar surface, a bottom planar surface opposite the top planar surface, and peripheral edges that extend between the top and bottom planar surfaces, the top and bottom planar surfaces terminating at the peripheral edges, the peripheral edges collectively defining a perimeter of the flat body of the first facing sheet, the top planar surface comprising a peripheral edge portion adjacent the perimeter; and a coupling mechanism attached to the bottom surface of the grid support member, the coupling mechanism coupling the peripheral edge portion of the top planar surface of the first facing sheet to the bottom surface of the grid support member so that the first facing sheet is supported from the bottom surface of the grid support member;

wherein the bottom surface of the first grid support member is at least partially concealed by the first facing sheet, wherein the peripheral edge extends past the coupling mechanism.

2. The ceiling system of claim 1, wherein the first facing sheet is supported from the bottom surface of the grid support member independently of the ceiling panel.

3. The ceiling system of claim 1, wherein the coupling mechanism is selected from a group consisting of adhesives, magnets, and hook and loop closures.

4. The ceiling system of claim 3, wherein the coupling mechanism comprises double-sided adhesive tape.

5. The ceiling system of claim 1, wherein the first facing sheet is releasably coupled to the bottom surface of the grid support member.

6. The ceiling system of claim 1, further comprising a first spacer disposed between the first facing sheet and the bottom surface of the grid support member, the first spacer spacing the first facing sheet from the bottom surface by a first vertical distance.

7. The ceiling system of claim 6, wherein the first facing sheet has a rectilinear shape and the first spacer is attached to a first corner of the first facing sheet.

8. The ceiling system of claim 7, further comprising a second spacer attached to a second corner of the first facing sheet.

9. The ceiling system of claim 8, further comprising a resilient tensioning rod coupled between the first and second spacers, the tensioning rod urging the first and second corners apart to draw the first facing sheet taut and substantially flat.

10. The ceiling system of claim 1, wherein the ceiling panel has a honeycomb core structure.

11. The ceiling system of claim 1, wherein the first facing sheet is unattached to the ceiling panel.

12. The ceiling system of claim 1, wherein the grid support member is T-shaped and includes a bottom flange that defines the bottom surface.

13. A ceiling system comprising:

a first longitudinally-extending grid support member, a second longitudinally-extending grid support member, and a third longitudinally extending grid support member, the first grid support member located between and spaced apart from each of the second and third grid support members, each of the first, second and third grid support members defining a longitudinal axis and having a substantially horizontal bottom surface;

a first facing sheet and a second facing sheet, each of the first and second facing sheets comprising a flat body defined by a top surface, a bottom surface opposite the top surface, and peripheral edges that extend between the top and bottom surfaces of the first and second facing sheets, the peripheral edges collectively defining a perimeter of the flat body;

the first facing sheet spanning between the first and second grid support members, the top surface of the first facing sheet coupled to and supported from the bottom surfaces of the first and second grid support members; and the second facing sheet spanning between the first grid support member and the third grid support member, the top surface of the second facing sheet coupled to and supported from the bottom surfaces of the first and third grid support members;

wherein adjacent ones of the peripheral edges of the first and second facing sheets are proximate to each other below the bottom surface of the first grid support member;

wherein the bottom surface of the first grid support member is concealed by the first and second facing sheets, wherein the peripheral edge extends past the coupling mechanism.

14. The ceiling system of claim 13, further comprising a coupling mechanism that couples the top surfaces of the first and second facing sheets to the bottom surface of the first grid support member, the coupling mechanism selected from a group consisting of adhesive coupling, magnetic coupling, and hook and loop coupling.

15. The ceiling system of claim 13, wherein the first facing sheet is unattached to the ceiling panel and only supported from the bottom surface of the grid support member.

16. The ceiling system of any of claim 13, wherein the first and second facing sheets are releasably coupled to the bottom surface of the first grid support member.

17. The ceiling system of claim 16, wherein:

the coupling mechanism includes a second spacer disposed between the second facing sheet and the bottom surface of the first grid support member, the second spacer spacing the second facing sheet from the bottom surface by a first vertical distance; and wherein the adjacent ones of the peripheral edges of the first and second facing sheets are substantially flush with one another.

18. The ceiling system of claim 13, wherein the adjacent ones of the peripheral edges of the first and second facing sheets are vertically offset from one another.

19. The ceiling system of claim 13, wherein the adjacent ones of the peripheral edges of the first and second facing sheets are substantially flush with one another.

20. A ceiling system comprising:

a longitudinally extending grid support member including a longitudinal axis and a substantially horizontal bottom surface;

a ceiling panel supported by the grid support member;

a first facing sheet having a flat body defined by a top planar surface, a bottom planar surface opposite the top planar surface, and peripheral edges that extend between the top and bottom planar surfaces, the top and bottom planar surfaces terminating at the peripheral edges, the peripheral edges collectively defining a perimeter of the flat body of the first facing sheet; and a coupling mechanism that couples the first facing sheet to the grid support member, the grid support member supporting the first facing sheet;

wherein the bottom surface of the first grid support member is at least partially concealed by the first facing sheet, wherein the peripheral edge extends past the coupling mechanism.

* * * * *